US009771691B2

(12) United States Patent
Howseman, Jr.

(10) Patent No.: US 9,771,691 B2
(45) Date of Patent: Sep. 26, 2017

(54) INTEGRAL MELTER AND PUMP SYSTEM FOR THE APPLICATION OF BITUMINOUS ADHESIVES AND HIGHWAY CRACK-SEALING MATERIALS, AND A METHOD OF MAKING THE SAME

(71) Applicant: William E. Howseman, Jr., Camarillo, CA (US)

(72) Inventor: William E. Howseman, Jr., Camarillo, CA (US)

(73) Assignee: DISPENSING TECHNOLOGY CORPORATION, Camarillo, CA (US)

( * ) Notice: Subject to any disclaimer, the term of this patent is extended or adjusted under 35 U.S.C. 154(b) by 86 days.

(21) Appl. No.: 15/008,773

(22) Filed: Jan. 28, 2016

(65) Prior Publication Data

US 2017/0218575 A1 Aug. 3, 2017

(51) Int. Cl.

| | |
|---|---|
| ***B67D 7/80*** | (2010.01) |
| ***E01C 11/24*** | (2006.01) |
| ***B05C 5/00*** | (2006.01) |
| ***B05C 5/02*** | (2006.01) |

(Continued)

(52) U.S. Cl.

CPC ..... *E01C 11/24* (2013.01); *B05C 5/001* (2013.01); *B05C 5/02* (2013.01); *F27B 14/0806* (2013.01);

(Continued)

(58) Field of Classification Search

CPC . B05C 5/001; B05C 5/0025; B05C 17/00576; E01C 19/00; E01C 19/08; E01C 11/24; C10C 3/12

(Continued)

(56) References Cited

U.S. PATENT DOCUMENTS 2,839,332 A * 6/1958 Sackett ..... B05B 9/002 118/302

3,359,970 A * 12/1967 Pedersen ..... E04D 15/07 126/343.5 A (Continued)

*Primary Examiner* — Lien Ngo

(74) *Attorney, Agent, or Firm* — Law Offices of Steven W. Weinrieb

(57) ABSTRACT

An integral melter and pump assembly or system, and a method of making the same, is disclosed wherein the pump assembly comprises a melter housing having a melter container defined within the melter housing. A pump mounting plate is integrally mounted within a side wall portion of the melter container and an output dispensing supply pump is mounted directly upon an external surface portion of the pump mounting plate in a surface-to-surface manner such that heat generated internally within the melter container is effectively transferred by conduction from the melter container and through the pump mounting plate such that the temperature level of the output pump is elevated to, and maintained at, a predeterminedly desired level even when the pump, is not disposed in its output dispensing mode. In addition, since the output dispensing or material supply pump is disposed externally of the melter container and the melter housing, the output dispensing or material supply pump is easily and readily accessible in case maintenance becomes necessary. Optionally, an oil jacket or chamber can surround the melter container so as to more evenly or consistently provide heating of the melter container.

17 Claims, 11 Drawing Sheets

(51) Int. Cl.
*F27B 14/08* (2006.01)
*F27B 14/14* (2006.01)
*F27B 14/00* (2006.01)

(52) U.S. Cl.
CPC ..... *F27B 14/143* (2013.01); *F27B 2014/002* (2013.01)

(58) Field of Classification Search
USPC ..... 222/146.2, 146.5, 592, 593; 366/23–25; 404/77, 79, 95, 113, 115, 101, 109, 110
See application file for complete search history.

(56) References Cited

U.S. PATENT DOCUMENTS 3,841,527 A * 10/1974 Von Roeschlaub . E01C 23/0973 222/146.2
4,159,877 A 7/1979 Jacobson et al.
4,620,645 A * 11/1986 Hale ..... E01C 19/16 126/343.5 A
4,692,028 A 9/1987 Schave
4,859,073 A 8/1989 Howseman, Jr. et al.
4,887,741 A 12/1989 Downing
4,887,908 A 12/1989 Montgomery et al.
4,944,632 A * 7/1990 Dillingham ..... E01C 23/06 404/101
5,832,178 A 11/1998 Schave
5,967,375 A 10/1999 Barnes
5,974,227 A 10/1999 Schave
6,049,658 A 4/2000 Schave et al.
6,109,826 A 8/2000 Mertes
6,663,016 B2 12/2003 Bien

* cited by examiner

INTEGRAL MELTER AND PUMP SYSTEM FOR THE APPLICATION OF BITUMINOUS ADHESIVES AND HIGHWAY CRACK-SEALING MATERIALS, AND A METHOD OF MAKING THE SAME

FIELD OF THE INVENTION

The present invention relates generally to apparatus for dispensing heated adhesives or similar materials, and more particularly to a new improved integral melter and pump system for dispensing or applying heated bituminous adhesives and/or highway crack-sealing materials to roadway surfaces.

BACKGROUND OF THE INVENTION

Apparatus for melting adhesives or crack-sealing materials within a propane, electric, or diesel powered melter, and for applying such adhesives or materials to roadway surfaces, are well known in the art. Exemplary patents disclosing such apparatus or systems comprise U.S. Pat. No. 6,663,016 which issued to Bien on Dec. 16, 2003, U.S. Pat. No. 6,109,826 which issued to Mertes on Aug. 29, 2000, U.S. Pat. No. 6,049,658 which issued to Schave et al. on Apr. 11, 2000, U.S. Pat. No. 5,974,227 which issued to Schave on Oct. 26, 1999, U.S. Pat. No. 5,967,375 which issued to Barnes on Oct. 19, 1999, U.S. Pat. No. 5,832,178 which issued to Schave on Nov. 3, 1998, U.S. Pat. No. 4,887,908 which issued to Montgomery et al. on Dec. 19, 1989, U.S. Pat. No. 4,887,741 which issued to Downing on Dec. 19, 1989, U.S. Pat. No. 4,859,073 which issued to Howseman, Jr. et al. on Aug. 22, 1989, U.S. Pat. No. 4,692,028 which issued to Schave on Sep. 8, 1987, U.S. Pat. No. 4,620,645 which issued to Hale on Nov. 4, 1986, U.S. Pat. No. 4,159,877 which issued to Jacobson et al. on Jul. 3, 1979, and U.S. Pat. No. 3,841,527 which issued to Von Roeschlaub on Oct. 15, 1974.

U.S. Pat. No. 6,109,826 issued to Mertes on Aug. 29, 2000, is one example of a prior art melter and applicator system which was apparently state-of-the-art at the time that such patent issued in connection with the application of materials to be dispensed in connection with road paving or sealing operations, however, as can be appreciated from FIG. 1 of the application drawings, which corresponds to FIG. 1 of the noted patent, the system of Mertes embodies some fundamental operational problems. In accordance with the system of Mertes, a bin 26 is disclosed for containing the particular materials to be melted. More particularly, the bin 26 is provided with an access cover 28 so as to permit solidified paving materials, such as, for example, asphalt bricks to be loaded into the bin 26. An agitator 52 is rotatably disposed within the bottom portion of the bin 26 so as to constantly mix the heated and melted paving materials when heat is applied to the bin 26 so as to in fact heat and melt the paving materials disposed therewithin. Surrounding the bin 26 is a heating chamber 38 which is adapted to be heated by means of a heating system 30 which includes one or more burners 32 that receive fuel from a fuel supply container 34. A chimney 40 is fluidically connected to the heating chamber 38 so as to effectively exhaust combustion byproducts from the heating chamber 38, and it is noted that the chimney 40 is likewise fluidically connected to the upper region of the bin 26 by means of a chimney tube 42 so as to likewise exhaust any gaseous by-products effectively trapped within the upper confines of the bin 26. In addition, a cabinet 44 is disposed adjacent to the heating system 30.

A vent 46 fluidically connects the heating chamber 38 with the interior of the cabinet 44 when the vent 46 is moved to an open position, and a recirculating pump 60 is disposed within the cabinet 44. The pump 60 is connected to the bin 26 by means of an inflow pipe 62. The output side of the pump 60 comprises an outlet pipe 66 which is fluidically connected to a manifold 68. In turn, a supply line 72, fluidically connected at one end there-of to a heated material dispensing hose 74, is fluidically connected at a second end thereof to a first portion of the manifold 68 through means of a shutoff valve 76, while a recirculation outflow pipe 70, which is fluidically connected at a free end thereof to the bin 26 so as to recirculate the heated fluid back into the bin 26, is fluidically connected at a second end thereof to a second portion of the manifold 68 through means of a differential valve 78. When the heated material is not actually being dispensed, it is recirculated by the pump 60 back to the bin 26. The primary operational problems with a system such as that disclosed within Mertes reside in the fact that the pump 60 is indirectly heated as a result of being located within the interior portion of the cabinet 44, and therefore the degree or level to which the pump 60 is actually heated, in order to effectively preserve the fluidity and/or viscosity of the heated material to predeterminedly desirable values, is difficult to achieve. In addition, as has been noted hereinbefore, when the heated material is not being dispensed as a result of the pump 60 conveying the heated material to the dispensing hose 74, the heated material is being recirculated by the pump 60 back to the bin 26. Accordingly, the pump 60 is effectively always in operation, resulting in excessive wear of the pump components and seals.

With reference now being made to FIG. 2 of the application drawings, which corresponds to FIG. 1 of U.S. Pat. No. 4,859,073 which issued to Howseman, Jr. et al. on Aug. 22, 1989, the disclosed system is another example of a prior art melter and pump assembly which was apparently also state-of-the-art at the time that such patent issued in connection with the supply of similar materials for road paving or sealing operations, however, as can be appreciated from FIG. 2 of the application drawings which corresponds to FIG. 1 of Howseman, Jr. et al., there is disclosed a first embodiment of the system of the melter and pump assembly of Howseman, Jr. et al. which also embodies some fundamental operational problems. In accordance with this first embodiment of the system of Howseman, Jr. et al., which sought to rectify the aforenoted deficiencies of Mertes by eliminating the indirect heating of the pump, as well as eliminating the need for the recirculation of the heated material back to the melter, the material melter and pump assembly of Howseman, Jr. et al. is seen to comprise container 10 within which there is disposed a rotary agitator assembly comprising a rotary motor 18, and a rotary tube 28 which is rotatably driven by means of the motor 18 through means of rotary gears or sprockets 22, 24 interconnected by means of a chain drive 26. Agitator blades 34 are fixedly connected to the rotary tube 28, and a piston pump 46 is axially disposed within the lower end portion of the rotary tube 28 whereby reciprocation of the piston pump 26, relative to a pump ring 40, drives a mixture of the heated material, disposed within the container 10, outwardly from the container 10 and through the central or axial hole defined within the pump ring 40 and through an output dispensing conduit 49. The piston pump 46 is secured to the lower end of a vertical shaft 44, which is coaxially disposed within the rotary tube 28, and the upper end of the vertical shaft 44 is operatively connected to a reciprocating pump drive piston motor 20.

As has been noted hereinbefore, this first embodiment of the assembly of Howseman, Jr. et al. admittedly rectifies the aforenoted problems characteristic of the system of Mertes in that since the pump 46 is effectively disposed in a submerged state within the heated and melted material, the pump 46 will automatically be at the same temperature as the heated and melted material. In addition, there is no need for recirculating the heated or melted material when the pump is not activated for a dispensing operation because the heated or melted material within the pump will never be disposed at a lower temperature which could otherwise cause the heated or melted material to begin to solidify within the pump and cause blockage of the same. However, it is noted that the pump 46 is located within the lower portion of the melter or container 10, and accordingly, if the pump 46 requires servicing, maintenance, or replacement, maintenance personnel must actually climb into and descend downwardly toward the bottom portion of the melter or container 10 in order to gain access to the pump 46 and/or the pump plate 40. This entails dirty, time-consuming, and uncomfortable maintenance procedures to be undertaken.

With reference now being made to FIG. 3 of the application drawings, which corresponds to FIG. 3 of the Howseman, Jr. et al. patent and which discloses a second embodiment of the Howseman, Jr. et al. assembly, the melter or container is disclosed at 54, the pump shaft is disclosed at 50, and the pump is disclosed at 52. It is noted that in lieu of the pump 52 being disposed internally within the melter or container 54 as was the pump 46 of the first embodiment disclosed within FIG. 2 of the application drawings, the pump 52 is fixedly secured to an undersurface or external wall portion of the floor member of the melter or container 54. Therefore, the pump 52 in this embodiment is readily accessible by maintenance personnel, however, a burner, not shown, is adapted to be disposed beneath the pump such that the output of the burner impinges directly upon the pump whereby, over a period of time, the structural integrity of the pump can be compromised. It is also to be noted that the burner, not shown, is likewise disposed beneath the material output dispensing conduit 49 of the first embodiment shown in FIG. 2 of the application drawings such that, in a similar manner, over a period of time, not only is the structural integrity of the material output dispensing conduit 49 likewise to be compromised, but in addition, the material being dispensed can effectively be overcooked or charred.

With reference being made to FIGS. 4A and 4B of the application drawings, which correspond to FIGS. 2A and 2B of U.S. Pat. No. 4,692,028 which issued to Schave on Sep. 8, 1987, this disclosed system is yet still another example of a prior art melter and pump/applicator assembly which was apparently also state-of-the-art at the time that such patent issued in connection with the supply of similar materials for road paving or sealing operations, however, as can be appreciated from FIGS. 4A and 4B of the application drawings which correspond to FIGS. 2A and 2A of the patent to Schave, the system of Schave likewise embodies some fundamental operational problems. In accordance with the system of Schave, a sealant melting chamber is disclosed at 18, and a sealant agitator 34 is rotatably disposed internally of the melting chamber 18. A hydraulic pump 26, which is fluidically connected to a hydraulic fluid reservoir, is also fluidically connected to a two-position diverter valve 30 which can obviously attain two different positions as illustrated within FIGS. 4A and 4B. When the diverter valve 30 is disposed at the position illustrated within FIG. 4A, the hydraulic fluid from hydraulic pump 26, which is fluidically connected to the hydraulic fluid reservoir, is routed through the diverter valve 30 to a hydraulic motor 38 which serves to drive a sealant pump 38 which delivers sealant material to a sealant applicator hose 42. To the contrary, when dispensing of the sealant material is not to be accomplished, the diverter valve 30 is rotated to its other position so as to be disposed at the position illustrated within FIG. 4B whereby the hydraulic fluid from hydraulic pump 26 is routed through diverter valve 30 to hydraulic motor 32 which serves to rotate the sealant agitator 34. The hydraulic fluid is then returned to the hydraulic fluid reservoir. It can therefore be readily appreciated that since both the sealant agitator 34 and the sealant pump 40 are only operated intermittently and alternatively with respect to each other, the sealant disposed within the sealant melting chamber 18 is not continuously mixed and agitated such that the same may not always comprise the desired consistency or viscosity. In a similar manner, since sealant pump 40 is also operated only intermittently or periodically when dispensing of the sealant material is to be achieved, or is not being achieved, and since the sealant pump 40 is disposed externally of the sealant melting chamber 18, the sealant pump 40 will not always be operating at an elevated temperature level such that sealant material within the sealant pump 40 may tend to solidify and thereby clog the sealant pump 40. Still further, it is to be noted that the only connection between the sealant pump 40 and the sealant melting chamber 18 appears to be an outlet pipe, not numbered, which fluidically connects the sealing melting chamber 18 to the sealant pump 40 such that when the sealant pump 40 is actuated by means of the hydraulic motor 38, hot sealant material will flow through the sealant pump 40 and be discharged to the sealant applicator hose 42. When the sealant pump 40 is inoperative, sealant material does not flow through the sealant pump 40, and thus, the temperature level of the sealant pump 40 is not necessarily maintained at the desired elevated temperature level which is a sufficiently high temperature level in order to prevent any solidification of the sealant material within the sealant pump 40 such that clogging of the sealant pump 40 does not occur.

A need therefore exists in the art for a new and improved integral melter and pump system, and a method of making the same, that will effectively address and resolve the aforenoted problems or drawbacks characteristic of the current state of the art and that will achieve the following overall objectives. More particularly, a need exists in the art for a new and improved integral melter and pump system, and a method of making the same, wherein the pump does not operate continuously, either in a pump output supply mode or in a pump recirculation mode, so as not to experience excessive wear, wherein the pump is disposed at a location relative to the melter or material container so as to be sufficiently and constantly/continuously heated to a predetermined temperature level without having its structural integrity compromised, and regardless of whether or not the pump is being operated in its pump output supply mode such that solidification of the material to be dispensed will not solidify and clog the pump, and wherein further, the pump is mounted upon the melter or material container so as to be readily accessible for maintenance repairs or replacement by maintenance personnel.

OVERALL OBJECTIVES OF THE INVENTION

The overall objectives of the present invention are to overcome the drawbacks characteristic of, and encountered with current state-of-the-art melter and pump assemblies, and more particularly to have an integral melter and pump assembly or system, and a method of making the same, wherein the pump is not operated continuously either in a pump output mode or a pump recirculation mode such that the pump does not undergo excessive wear, wherein the pump is mounted at a location relative to the melter or material container such that the pump will be sufficiently and continuously heated to a predetermined temperature level without having its structural integrity compromised, and regardless of whether or not the pump is being operated in its pump output supply mode, so that the material being pumped will not solidify within the pump and therefore clog the same, and wherein the pump is mounted at a location relative to the melter or material container such that the material supply pump is readily accessible for maintenance repairs or replacement by maintenance personnel.

SUMMARY OF THE INVENTION

The foregoing and other objectives are achieved in accordance with the teachings and principles of the present invention through the provision of a new and improved integral melter and pump assembly or system, and a method of making the same, wherein the integral melter and pump assembly or system comprises a melter housing having a melter container defined within the melter housing. A pump mounting plate is integrally mounted within a side wall portion of the melter container and an output dispensing or material supply pump is mounted directly upon an external surface portion of the pump mounting plate in a surface-to-surface manner such that heat generated internally within the melter container is effectively transferred by conduction from the melter container and through the pump mounting plate such that the temperature level of the output dispensing or material supply pump is elevated to, and maintained at, a predeterminedly desired level even when the output dispensing or material supply pump is not disposed in its output dispensing mode with heated materials being conveyed through the output dispensing or material supply pump. In addition, since the output dispensing or material supply pump is disposed externally of the melter container and the melter housing, the output dispensing or material supply pump is easily and readily accessible in the case that service, maintenance, repairs, or replacement become necessary. In accordance with a second embodiment of the present invention, an oil jacket or chamber surrounds the melter container so as to more evenly or consistently provide heating of the melter container which is important when certain materials, susceptible to charring, are being melted within the melter container.

BRIEF DESCRIPTION OF THE DRAWINGS

Various other features and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 1:
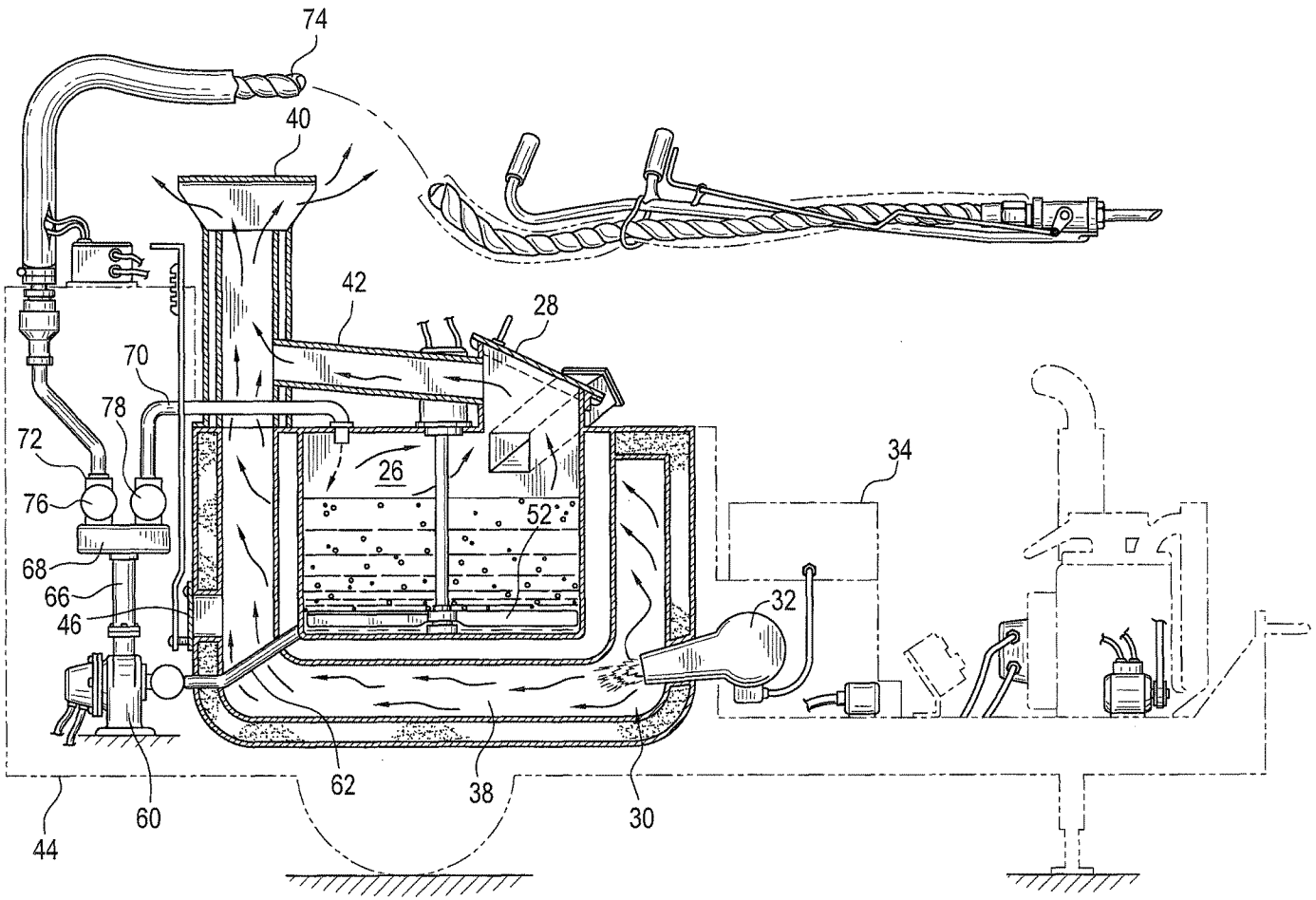
FIG. 1 (PRIOR ART)
FIG. 1 is a schematic cross-sectional view of a first prior art melter and pump system which corresponds to FIG. 1 of U.S. Pat. No. 6,109,826 which issued to Mertes on Aug. 29, 2000.
Figure 2:
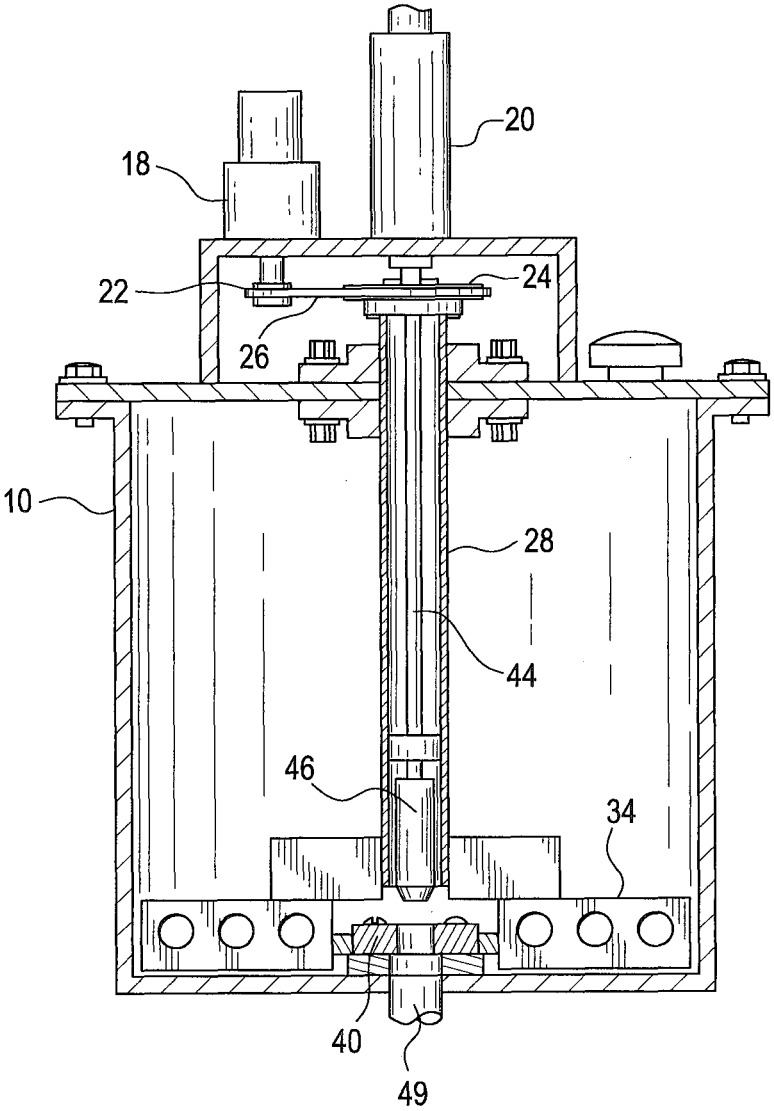
FIG. 2 (PRIOR ART)
FIG. 2 is a schematic cross-sectional view of a first embodiment of a second prior art melter and pump system which corresponds to FIG. 1 of U.S. Pat. No. 4,859,073 which issued to Howseman, Jr. et al. on Aug. 22, 1989.
Figure 3:
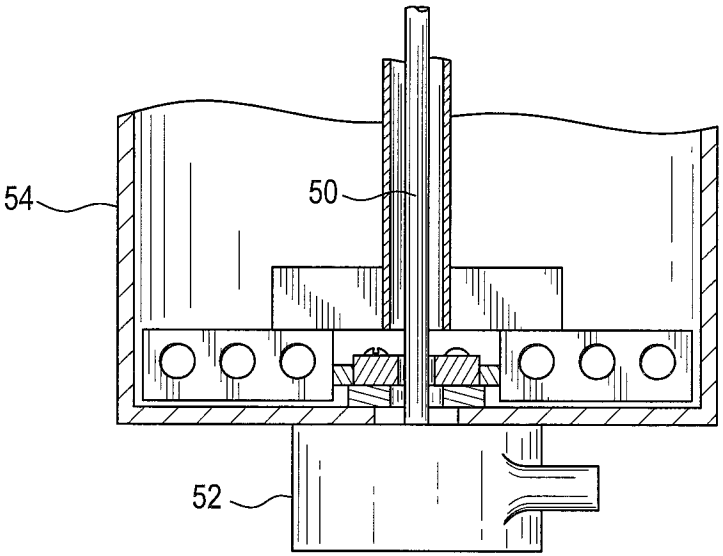
FIG. 3 (PRIOR ART)
FIG. 3 is a schematic cross-sectional view of a second embodiment of the prior art melter and pump system which corresponds to FIG. 3 of U.S. Pat. No. 4,859,073 which issued to Howseman, Jr. et al. on Aug. 22, 1989.
Figure 4A:
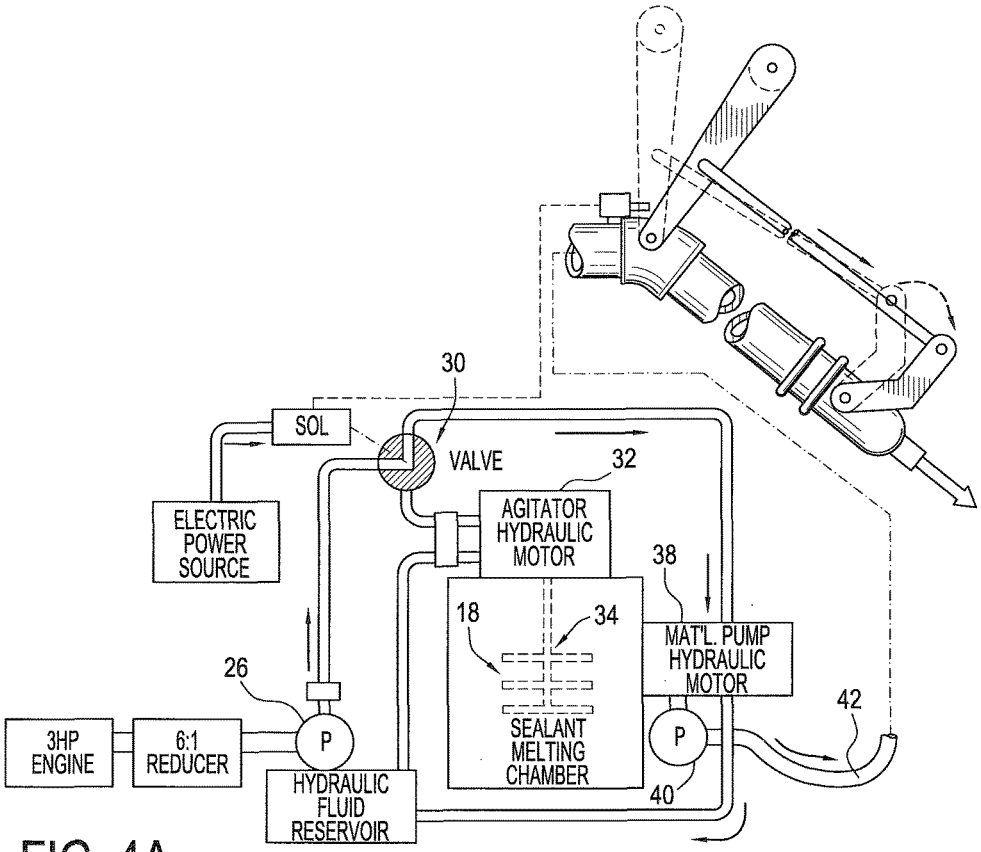
FIG. 4A (PRIOR ART)
FIG. 4A is a schematic fluid control circuit of another prior art melter and pump system which corresponds to FIG. 2A of U.S. Pat. No. 4,692,028 which issued to Schave on Sep. 8, 1987 wherein the pump has been activated so as to be disposed at its pump output supply mode.
Figure 4B:
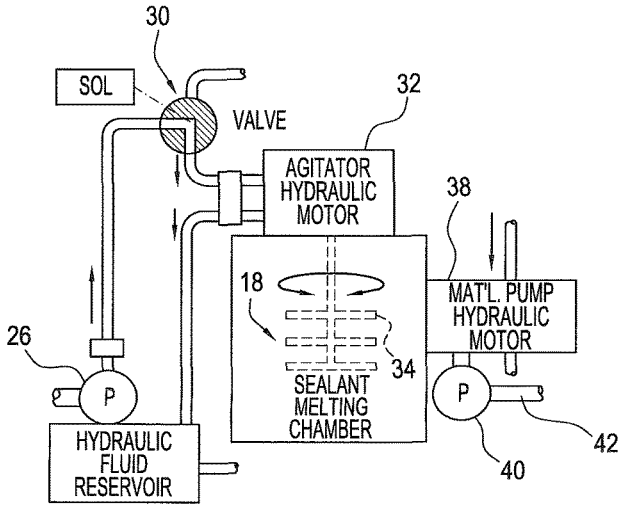
FIG. 4B (PRIOR ART)
FIG. 4B is a schematic fluid control circuit of another prior art melter and pump system which corresponds to FIG. 2B of U.S. Pat. No. 4,692,028 which issued to Schave on Sep. 8, 1987 wherein the pump has been deactivated so as not to be disposed at its pump output supply mode, and the hydraulic fluid that had been previously utilized to drive the hydraulic pump motor for driving the melted material output supply pump is now being recirculated within an enclosed hydraulic fluid circuit which serves to drive the sealant agitator.

Referring now to the drawings, and more particularly to FIGS. 5-11 thereof, a first embodiment of a new and improved integral melter and pump system or assembly, constructed in accordance with the principles and teachings of the present invention, is disclosed and is generally indicated by the reference character 100. The integral melter and pump assembly or system 100 is seen to comprise a melter housing 102 which effectively comprises an upstanding hollow cylinder having a circular cross-section, however, the melter housing 102 may have other cross-sectional configurations, such as, for example, a square cross-section, or even an obround cross-section, wherein an obround is well-known and defined as a geometrical configuration comprising, in effect, a flattened cylinder having two long sides disposed parallel to one another while the two opposite ends of the obround are hemispherical. As can best be appreciated from FIGS. 8-10, the melter housing 102 is further seen to comprise three concentric substantially annular wall members, a first innermost wall member 104, a second intermediate wall member 106 radially spaced from said first innermost wall member 104 and surrounding the first innermost wall member 104, and a third outermost wall member 108 radially spaced from the second intermediate wall member 106 and surrounding the second intermediate wall member 106. The innermost wall member 104 has a floor member 110 integrally connected thereto so as to effectively define with the innermost wall member 104 an internal melter container 112 within which various materials, such as, for example, bituminous adhesives and/or other highway crack-sealing materials for application to roadway surfaces, are to be disposed whereby such materials may be melted and subsequently dispensed for application to the roadway surfaces.

A burner box or chamber 114 is fixedly secured to a floor member 116 of the melter housing 102, and a burner assembly 118, which may be, for example, a diesel burner assembly which is mounted upon a face plate 120, is fixedly but re-movably mounted upon one side wall 122 of the burner box or chamber 114 by means of suitable bolts or fasteners 124. The burner assembly 118 has various controls, not shown, as well as a fan, also not shown, operatively associated there-with so as to control the combustion flames of the burner assembly 118 and to cause the combustion flames of the burner assembly 118 to enter the burner box or chamber 114. The mounting of the burner assembly 118 upon the face plate 120, and, in turn, the removable mounting of the face plate 120 upon the one side wall 122 of the burner box or chamber 114 by means of the bolts or fasteners 124 permits the burner assembly 118 to be readily and easily dismounted from the burner box or chamber 114 for servicing, maintenance, repairs, or replacement. It can also be clearly seen and appreciated from FIGS. 8-10 that an agitator 126 is rotatably mounted within the melter container 112, the agitator 126 comprising a plurality of agitator blades 128 which are fixedly mounted upon a lower portion of an upstanding rotary shaft 130. The lower end portion of the rotary shaft 130 is rotatably mounted within a bearing member 132, while the upper end portion of the rotary shaft 130 is rotatably connected to an agitator drive motor 134 which is fixedly mounted upon an upper cover or ceiling member 136 of the melter container 112.

Figure 5:
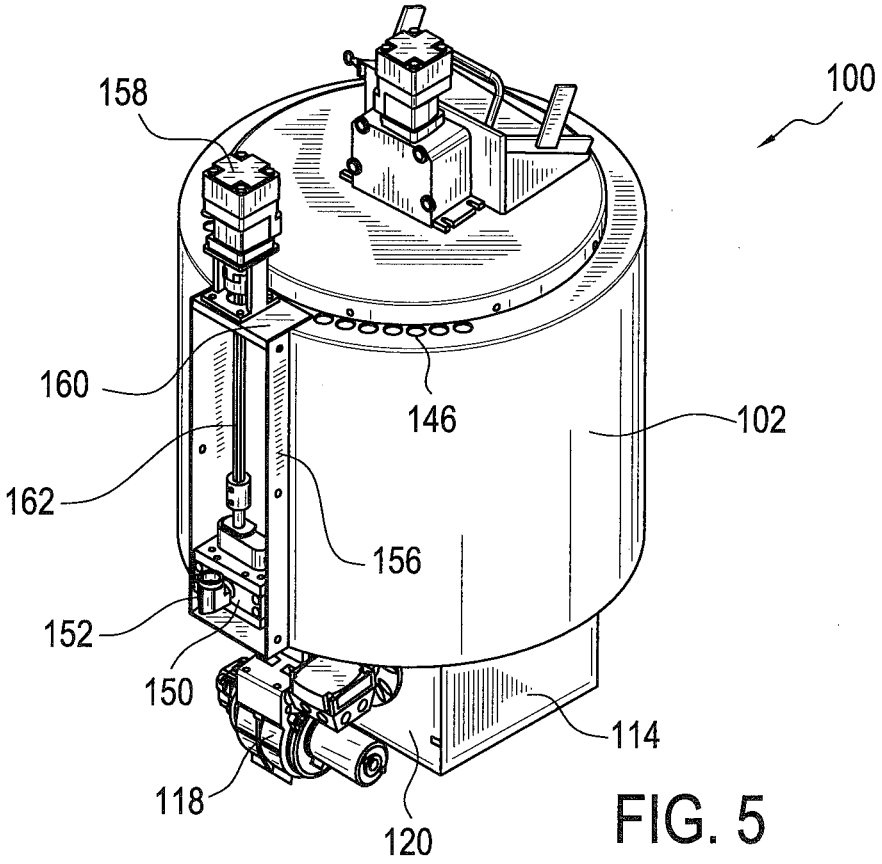
FIG. 5 is a schematic external perspective view of a first embodiment of a new and improved integral melter and pump system as constructed in accordance with the principles and teachings of the present invention.
Figure 6:
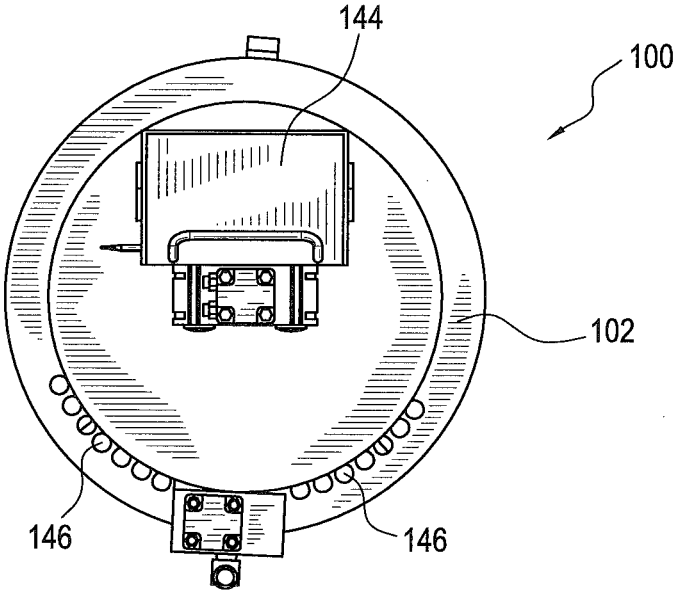
FIG. 6 is a schematic top plan view of the integral melter and pump system as shown in FIG. 5.
Figure 11:
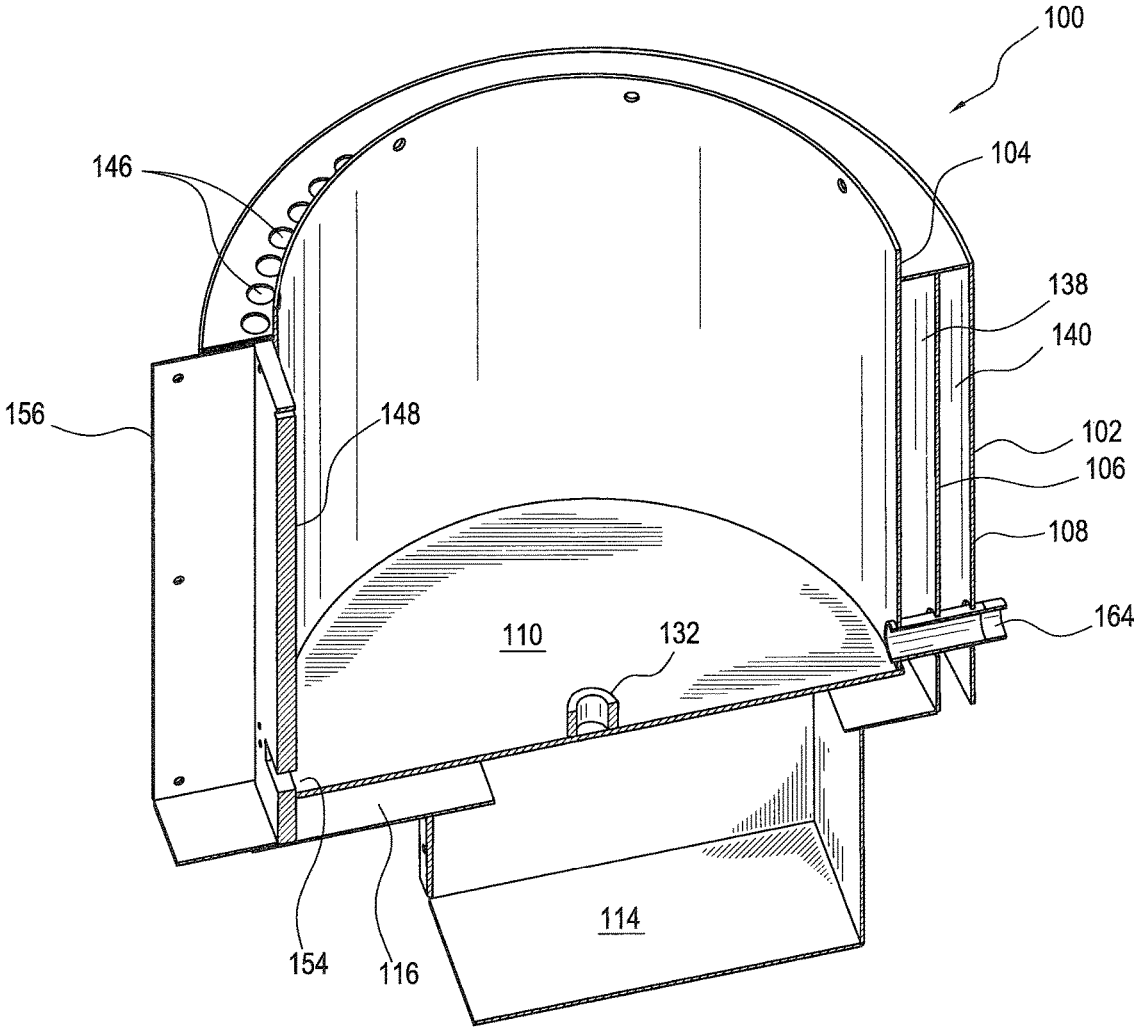
FIG. 11 is a schematic cross-sectional view of the integral melter and pump system, similar to that shown in FIG. 9 showing, however, the integral melter and pump system with some component parts removed so as to show other component parts more clearly.
Figure 12:
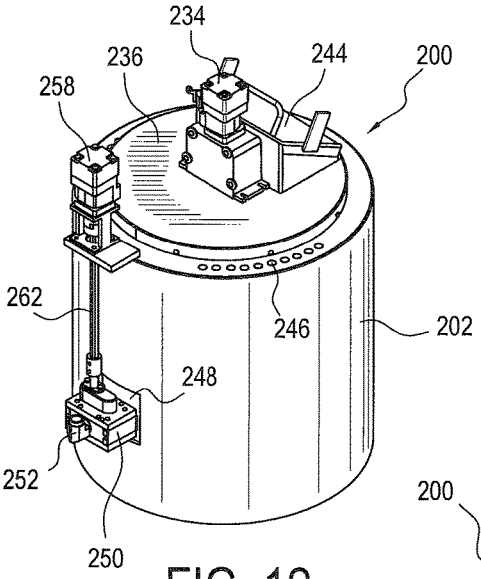
FIG. 12 is a schematic external perspective view of a second embodiment of a new and improved integral melter and pump system as constructed in accordance with the principles and teachings of the present invention.
Figure 13:
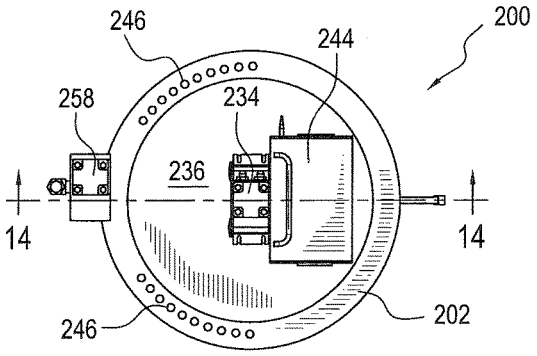
FIG. 13 is a schematic top plan view of the integral melter and pump system as shown in FIG. 12.
Figure 14:
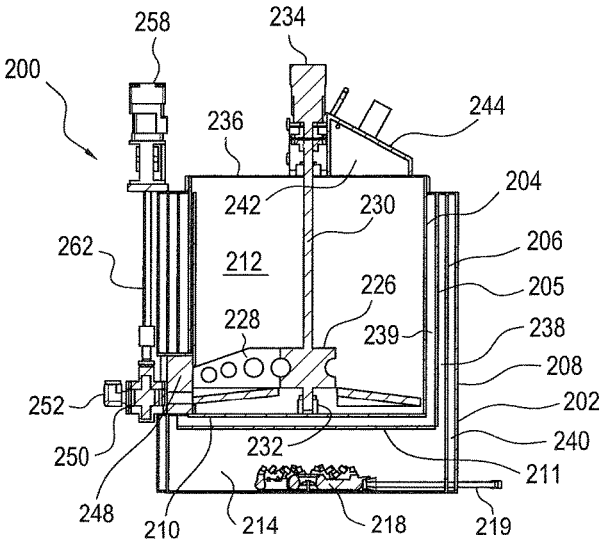
FIG. 14 is a cross-sectional view of the integral melter and pump system as shown in FIG. 13 as taken along the lines 14-14 of FIG. 13.
Figure 15:
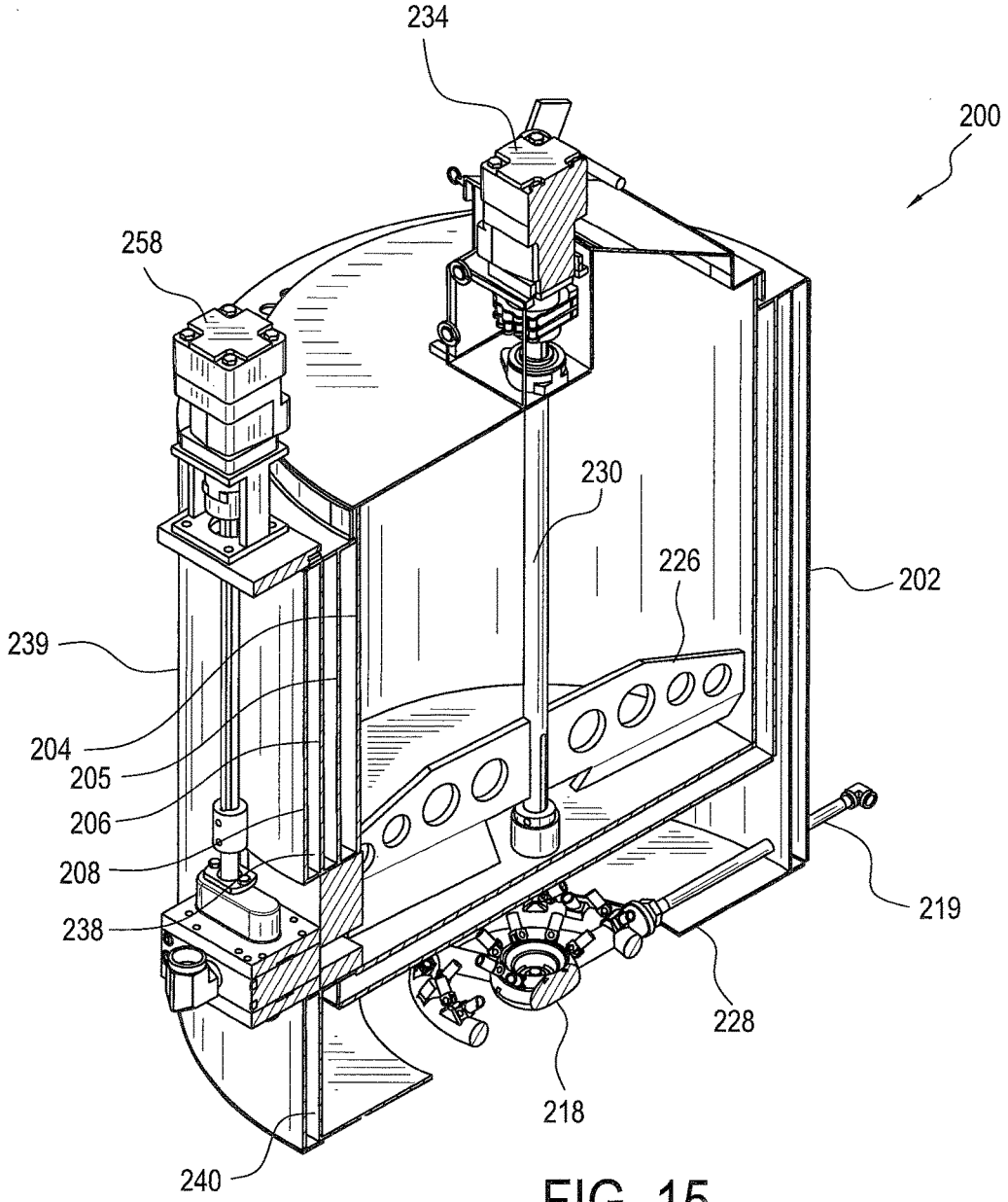
FIG. 15 is a schematic cross-sectional view of the integral melter and pump system, similar to that shown in FIG. 14 showing, however, the integral melter and pump system from a left-to-right angular perspective.

It is also to be appreciated that the three concentric substantially annular wall members 104, 106, 108 of the melter housing 102 define two concentric substantially annular chambers therebetween, that is, a first inner substantially annular chamber 138 surrounding the melter container 112, and a second outer substantially annular insulation chamber 140 surrounding the first inner substantially annual chamber 138. The first inner substantially annular chamber 138 is defined between the first innermost wall member 104 and the second intermediate wall member 106, while the second outer substantially annular chamber 140 is defined between the second intermediate wall member 106 and the third outermost wall member 108. It is also seen that the first inner substantially annular chamber 138 is fluidically connected to the burner box or chamber 114, and in this manner, it can readily be appreciated that the flames and heat generated by means of the burner 118, within the burner box or chamber 114, will be conveyed upwardly so as to effectively heat the floor member 110 of the melter container 112 as well as through the first inner substantially annular exhaust chamber 138 surrounding the melter container 112 so as to, in turn, effectively heat the first innermost annular wall member 104 of the melter container 112 by means of conduction. This heat will of course serve to melt solid bituminous or other adhesives and/or roadway materials which are charged into the melter container 112 through means of a material fill housing 142 which is fixedly mounted upon the upper cover or ceiling member 136 of the melter container 112 and which is provided with a movable fill lid, cover, or port 144. It is also noted that, with respect to this structural portion of the melter housing 102, the second outer substantially annular chamber 140 is adapted to be filled with an appropriate type of thermal insulation which may comprise, for example, air, a suitable ceramic material, a suitable type of wool or other fiber insulation, and the like. Lastly, while the upper end, top, or ceiling portion of the second outer substantially annular chamber 140 is closed or sealed, a plurality of vent holes 146, as can best be seen in FIGS. 5,6, and 11, are provided within the upper end, top, or ceiling portion of the first inner substantially annular chamber 138 so as to permit the flames and heat from the first inner substantially annular chamber 138 to escape to atmosphere in a substantially controlled manner so as to effectively ensure that the proper temperature level is present and maintained within the first inner substantially annular chamber 138 such that, in turn, a predetermined amount of heat is transferred to the innermost wall member 104 of the melter container 112. It is noted that the plurality of vent holes 146 are only provided within the two quadrants closest to the circumferential location where the burner 118 is located, and substantially opposite the circumferential location where the material fill housing 142 and the fill lid, cover, or port 144 are located so as to ensure the safety of operator personnel.

Continuing further, a unique feature characteristic of the present invention resides in the provision of a vertically extending planar pump mounting plate 148 which effectively forms a portion of the innermost wall member 104 of the melter container 112. In fabricating the melter housing 102, a section of the innermost wall member 104 is removed and the vertically extending planar pump mounting plate 148 is welded to residual portions of the innermost wall member 104 of the melter container 112 so as to effectively become an integral part of the innermost wall member 104 of the melter container 112 as a result of having replaced that section of the innermost wall member 104 of the melter container 112 that had been removed. A dispensing or output supply pump 150 is then mounted upon an external surface portion of the mounting plate 148 as can best be appreciated from FIGS. 8 and 9. In view of the fact that the dispensing or output supply pump 150 is mounted in a surface-to-surface manner directly upon the external surface of the planar pump mounting plate 148, which is now effectively an integral part of the melter container 112, heat from the melter container 112 is transmitted directly to the dispensing or output supply pump 150 by means of conduction through the planar pump mounting plate 148. In this manner, the dispensing or output supply pump 150 is maintained at an elevated temperature regardless of whether the dispensing or output supply pump 150 is actually disposed in a dispensing or output supply mode, or is not in fact disposed in a dispensing or output supply mode. In addition, it is also to be appreciated that as a result of the dispensing or output supply pump 150 being mounted upon the external surface portion of the mounting plate 148, relative to the melter container 112, safe and easy access to the dispensing or output supply pump 150 is effectively ensured so as not to endanger service personnel when performing service, maintenance, repair, or replacement operations in connection with the dispensing or output supply pump 150.

Figure 8:
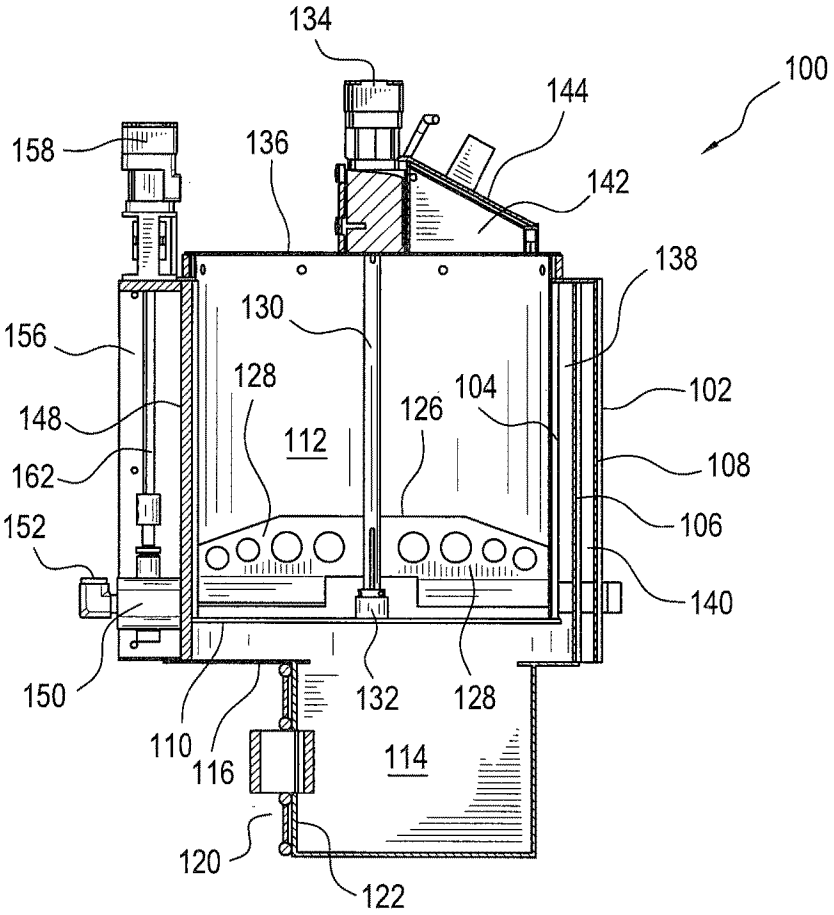
FIG. 8 is a cross-sectional view of the integral melter and pump system as shown in FIG. 7 as taken along the lines 8-8 of FIG. 7.
Figure 7:
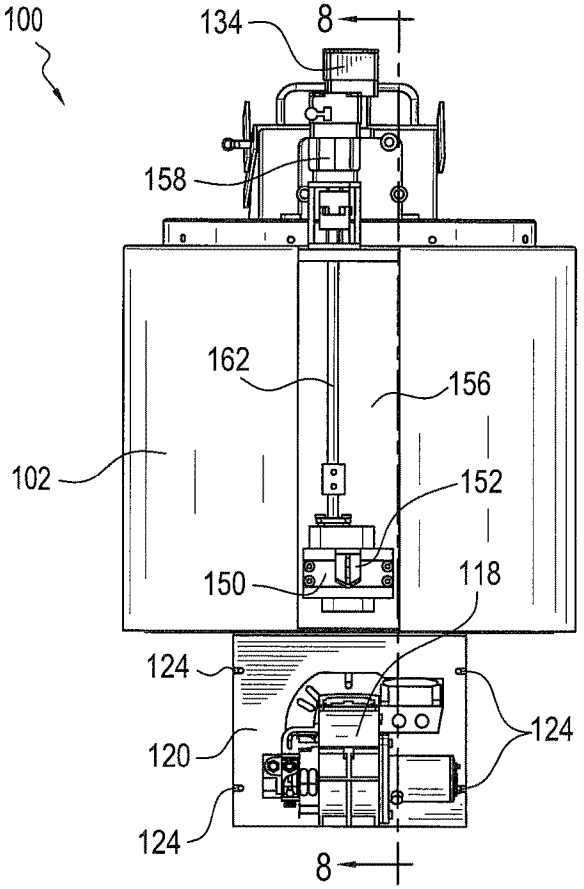
FIG. 7 is a schematic side elevational view of the integral melter and pump system as shown in FIGS. 5 and 6.
Figure 9:
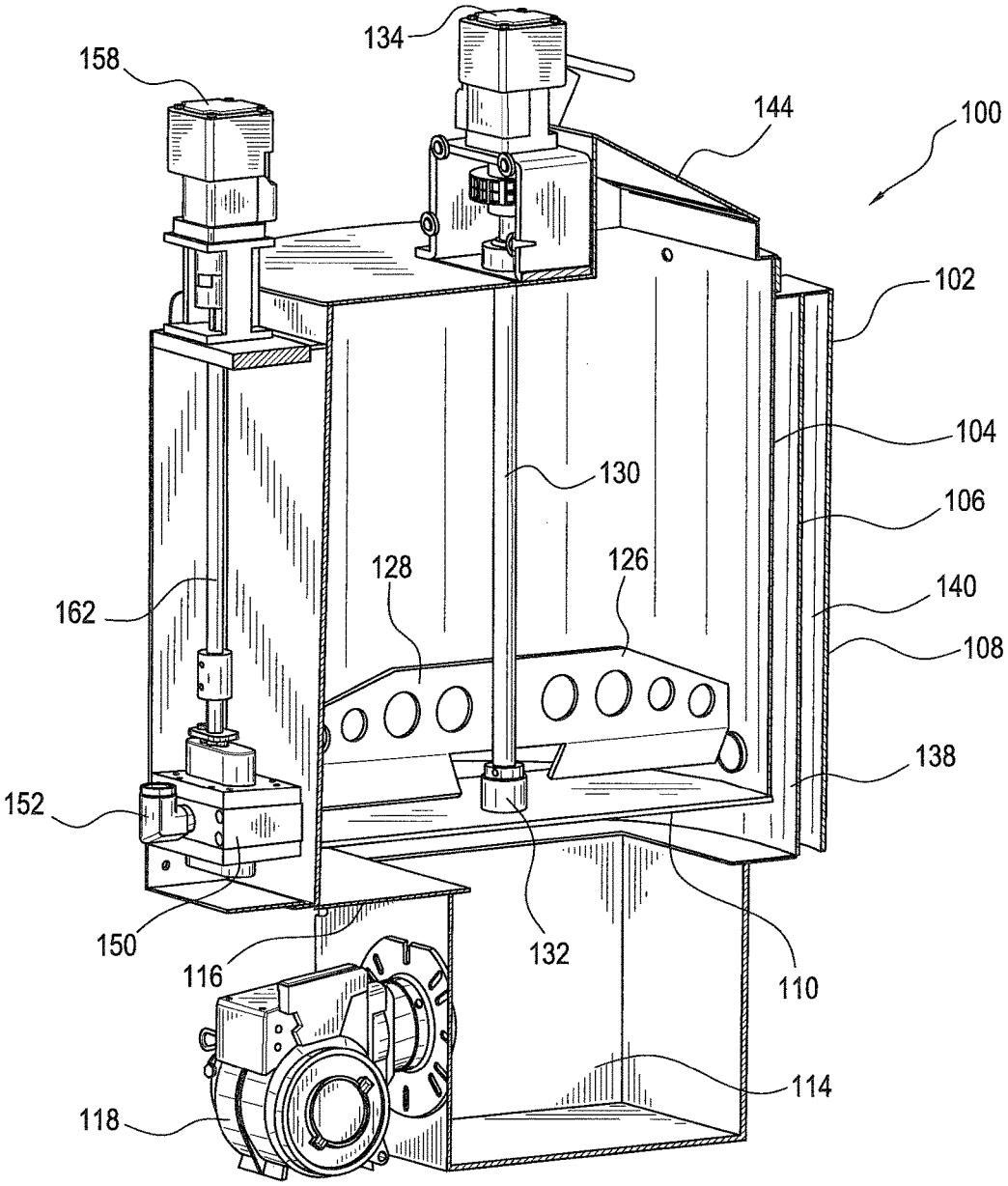
FIG. 9 is a schematic cross-sectional view of the integral melter and pump system, similar to that shown in FIG. 8 showing, however, the integral melter and pump system from a left-to-right angular perspective.
Figure 10:
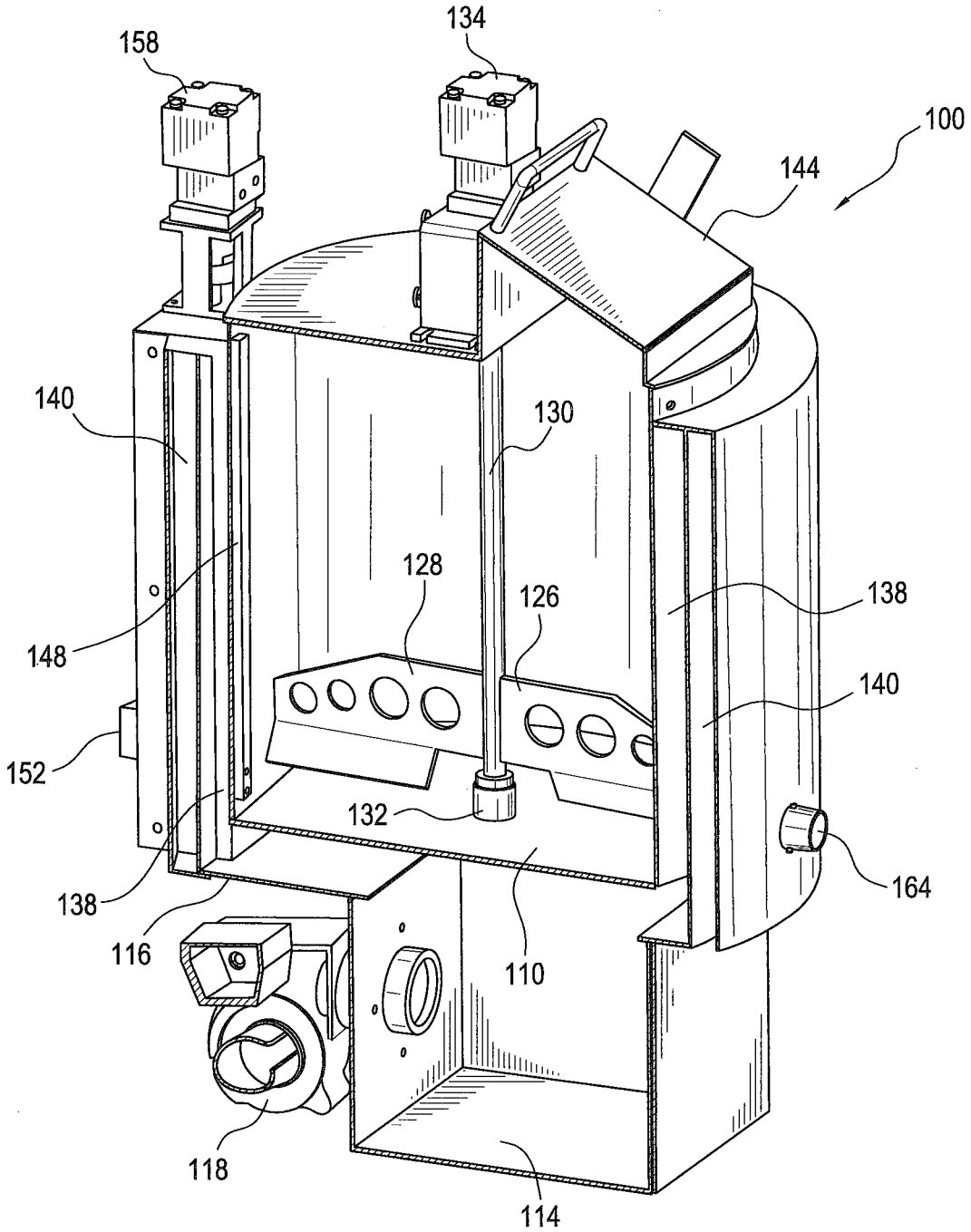
FIG. 10 is a schematic cross-sectional view of the integral melter and pump system, similar to that shown in FIGS. 8 and 9 showing, however, the integral melter and pump system from a right-to-left angular perspective.

As can also be readily appreciated from FIGS. 8 and 9, the output or supply end of the dispensing or output supply pump 150 is provided with an output or supply port, connection, or tap 152 to which a suitable roadway material supply hose, not shown, can be connected whereby the roadway materials being dispensed can be applied to the roadway surfaces. In a similar manner, as can best be appreciated from FIG. 11, a inlet or intake slot 154 is defined within a lower portion of the pump mounting plate 148 so as to be fluidically connected to the intake side of the dispensing or output supply pump 150. Still yet further, it can also be readily appreciated from FIGS. 5,9, and 11, that the dispensing or output supply pump 150 is disposed within a five-sided, vertically oriented enclosure 156. The disposition of the dispensing or output supply pump 150 within the enclosure 156 not only permits the same to be mounted upon the pump mounting plate 148 so as to achieve the aforenoted desired heat exchange between the melter container 112 and the dispensing or output supply pump 150, as well as to provide ready access to the dispensing or output supply pump 150 by maintenance personnel, but in addition, the disposition of the dispensing or output supply pump 150 within the enclosure 156, and the relative remote location of the dispensing or output supply pump 150 from the burner 118, effectively protects the dispensing or output supply pump 150 from the heat generated by the burner 118. As can also best be seen from FIGS. 5, 8, 9, and 10, a pump drive motor 158 is fixedly mounted upon the upper wall member 160 of the enclosure 156, and a vertically oriented pump drive shaft 162 extends downwardly from the pump drive motor 158 to the dispensing or output supply pump 150 so as to be operatively connected thereto. It is to be noted that the pump drive motor 158 can be any suitable pump drive motor, such as, for example, a hydraulic motor, an electric motor, or a pneumatic motor. Lastly, as can best be seen in FIGS. 10 and 11, it is noted that a drain port or conduit 164 is provided within a lower portion of the melter housing 102, and that the conduit 164 passes through the concentric substantially annular walls 104, 106, 108 of the melter housing 102 so as to be in fluidic communication with the interior of the melter container 112. In this manner, draining of the melter container 112 is permitted when the same is to be cleaned for periodic maintenance operations.

Lastly, with reference being made to FIGS. 12-15, a second embodiment of a new and improved integral melter and pump assembly or system is disclosed and is generally indicated by the reference character 200. It is to be noted that for the purposes of brevity, those component parts of the second embodiment of the melter and pump assembly or system 200 that correspond to component parts of the first embodiment of the melter and pump assembly or system 100 will not be discussed in detail but will be designated by corresponding reference numbers except that they will be within the 200 series. Furthermore, the description of the second embodiment of the integral melter and pump assembly or system 200 will be confined to the differences between the first and second embodiments of the integral melter and pump assemblies or systems 100, 200. More particularly, it is seen that a first primary difference between the first embodiment of the integral melter and pump assembly or system 100 and the second embodiment of the integral melter and pump assembly or system 200 resides in the fact that the diesel burner 118 of the first embodiment of the integral melter and pump assembly or system 100 has been eliminated and a propane burner 218 has effectively been installed within a burner box or chamber 214 located beneath the melter container 212. The propane burner 218 is provided with a fuel inlet supply line 219, and it is to be noted that the fuel inlet supply conduit 219 and the propane burner 218 may be removable from the melter housing 202 so as to permit easy cleaning and/or maintenance procedures to be performed upon the burner 218 or the fuel inlet supply line 219 as may be necessary.

A second primary difference between the first embodiment of the integral melter and pump assembly or system 100 and the second embodiment of the integral melter and pump assembly or system 200 resides in the fact that in lieu of the three concentric substantially annular wall members 104, 106, 108 comprising the melter housing 102 of the first embodiment of the integral melter and pump assembly or system 100, the melter housing 202 of the second embodiment of the integral melter and pump assembly or system 200 is seen to comprise four concentric substantially annular wall members 204, 205, 206, and 208. More particularly, it is seen that in addition to the innermost wall member 204, the intermediate wall member 206, and the outermost wall member 208, a fourth wall member 205 has effectively been interposed between the innermost wall member 204 and the intermediate wall member 206. It is also seen that this additional wall member 205 has a floor member 211 integrally connected thereto whereby the wall member 205 and the floor member 211 effectively define an annular oil chamber 239 which is annularly disposed around the melter container 212 as well as being disposed beneath the floor member 210 of the melter container 212. The purpose of the oil chamber 239 is to provide a more even, consistent, or uniform heat gradient throughout the melter container 212. This is important depending upon the particular material being melted. Some materials are susceptible to being overheated and charred, thus effectively rendering them non-useable for their intended purposes. By employing the oil chamber 239, the likelihood of such overheating or charring of the melted material within the melter container 212 is substantially reduced. In a manner similar to that of the first embodiment of the integral melter and pump assembly or system 100, it is seen that the additional wall member 205 and the intermediate wall member 206 together define the exhaust chamber 238 which is fluidically connected to the burner box or chamber 214, while the intermediate wall member 206 and the outermost wall member 208 define the insulation chamber 240.

Lastly, a third primary difference between the first embodiment of the integral melter and pump assembly or system 100 and the second embodiment of the integral melter and pump assembly or system 200 resides in the fact that in lieu of the vertically extending pump mounting plate 148 and the provision of the five-sided enclosure 156, a smaller pump mounting plate 248 has been mounted within a side wall portion of the melter housing 202. In view of the fact that the burner 118 is no longer disposed beneath the pump 250, but is, instead, located beneath the melter container 212, the five-sided enclosure 156 has been eliminated. As can also best be seen from FIG. 14, while the pump mounting plate 248 effectively extends radially through all four wall members 204, 205, 206, 208 such that the inner surface portion of the pump mounting plate 248 effectively comprises the inner peripheral wall of the melter container 212, the thickness of the pump mounting plate 248 may be reduced such that the inner surface portion of the pump mounting plate 248 will abut an outer surface portion of the additional wall member 205 comprising the outer wall member of the oil chamber 239, although, admittedly, this modification is not shown in the drawings.

Obviously, many variations and modifications of the present invention are possible in light of the above teachings. For example, more than one material dispensing output supply pump may be operatively connected to the melter container such that multiple dispensing operations can be achieved at one time and/or at different dispensing or deposition locations. In addition, it is noted that the melter can be fabricated from aluminum which facilitates the manufacturing process in that the pump mounting plate can be easily cast as an integral component part of the melter container as opposed to the need for welding the same within the side wall portion of the melter container. It is therefore to be understood that within the scope of the appended claims, the present invention may be practiced otherwise than as specifically described herein.

REFERENCE NUMBER KEY

100—First embodiment of integral melter and pump assembly or system
102—Melter housing
104—Innermost concentric wall of melter housing
106—Intermediate concentric wall of melter housing
108—Outermost concentric wall of melter housing
110—Floor of melter container
112—Melter container
114—Burner box or chamber
116—Floor member of melter housing
118—Burner
120—Face plate upon which burner is mounted
122—Side wall of burner box or chamber upon which face plate is mounted
124—Bolts or fasteners
126—Agitator
128—Agitator blades
130—Rotary agitator mounting shaft
132—Bearing for agitator shaft
134—Agitator drive motor
136—Upper cover of melter container
138—First inner annular exhaust chamber surrounding the melter container
140—Second outer annular insulation chamber
142—Material fill housing
144—Lid, cover, or port of material fill housing
146—Vent holes for first inner annular chamber surrounding the melt chamber
148—Pump mounting plate of melter container
150—Dispensing or output supply pump
152—Material dispensing connection, port, or tap of dispensing or output pump
154—Intake slot of dispensing or output supply pump
156—Enclosure mounting dispensing or output supply pump upon melter container
158—Pump drive motor
160—Upper wall of enclosure
162—Pump drive shaft
164—Drain port
200—Second embodiment of integral melter and pump assembly or system
202—Melter housing
204—Innermost concentric wall of melter housing
205—Additional wall of melter housing
206—Intermediate concentric wall of melter housing
208—Outermost concentric wall of melter housing
210—Floor of melter container
211—Floor of oil chamber
212—Melter container
214—Burner box or chamber
216—Floor member of melter housing
218—Burner
219—Fuel inlet supply conduit for burner
226—Agitator
228—Agitator blades
230—Rotary agitator mounting shaft
232—Bearing for agitator shaft
234—Agitator drive motor
236—Upper cover of melter container
238—First inner annular exhaust chamber surrounding the melter container
239—Annular oil chamber
240—Second outer annular insulation chamber
242—Material fill housing
244—Lid, cover, or port of material fill housing
246—Vent holes for first inner annular chamber surrounding the melt chamber
248—Pump mounting plate of melter container
250—Dispensing or output supply pump
252—Material dispensing connection, port, or tap of dispensing or output pump
258—Pump drive motor
262—Pump drive shaft

What is claimed as new and desired to be protected by Letters Patent of the United States of America, is:

1. An integral melter and pump system, comprising:

a melter container for containing melted material to be dispensed, and comprising a floor member and a first annular wall member integrally connected to said floor member and having an inner peripheral surface facing an interior portion of said melter container and an outer peripheral surface external of said melter container;

a burner for providing heat to said melter container for melting material charged into said melter container such that the material charged into said melter container is melted by the heat from said burner;

a burner chamber disposed beneath said floor member of said melter container and disposed in fluidic communication with said burner such that heat from said burner is transmitted into said burner chamber such that the heat present within said burner chamber heats said floor member of said melter container;

a second annular wall member radially spaced from said first annular wall member and surrounding said first annular wall member so as to define with said first annular wall member an annular heating chamber fluidically connected to said burner chamber so as to receive heat from said burner chamber which will thereby heat said first annular wall member of said melter container; and an output dispensing supply pump mounted directly upon said outer peripheral surface of said first annular wall member of said melter container in a surface-to-surface manner such that heat from said interior portion of said melter container is transmitted, by conduction, through said first annular wall member of said melter container and to said output dispensing supply pump in order to constantly maintain said output dispensing supply pump in a heated state.

2. The integral melter and pump system as set forth in claim 1, wherein:

a planar pump mounting plate is integrally affixed within said first annular wall member of said melter container; and said output dispensing supply pump is mounted directly upon said planar pump mounting plate in a surface-to-surface manner such that heat from said interior portion of said melter container is transmitted, by conduction, through said planar pump mounting plate and to said output dispensing supply pump in order to constantly maintain said output dispensing supply pump in a heated state.

3. The integral melter and pump system as set forth in claim 1, wherein:

a planar pump mounting plate is integrally affixed upon said first annular wall member of said melter container; and said output dispensing supply pump is mounted directly upon said planar pump mounting plate in a surface-to-surface manner such that heat from said interior portion of said melter container is transmitted, by conduction, through said planar pump mounting plate and to said output dispensing supply pump in order to constantly maintain said output dispensing supply pump in a heated state.

4. The integral melter and pump system as set forth in claim 1, wherein:

said burner is mounted upon an external wall portion of said burner chamber so as to be readily accessible to maintenance personnel for the performance of maintenance operations.

5. The integral melter and pump system as set forth in claim 4, wherein:

said burner comprises a diesel fuel burner.

6. The integral melter and pump system as set forth in claim 1, wherein:

said burner is removably mounted within said burner chamber so as to be readily accessible to maintenance personnel for the performance of maintenance operations.

7. The integral melter and pump system as set forth in claim 6, wherein:

said burner comprises a propane type burner.

8. The integral melter and pump system as set forth in claim 1, further comprising:

a third annular wall member radially spaced from said second annular wall member, and surrounding said second annular wall member so as to define with said second annular wall member an annular insulation chamber.

9. The integral melter and pump system as set forth in claim 8, further comprising:

a fourth annular wall member spaced radially outwardly from said first annular wall member, spaced radially inwardly of said second annular wall member, and surrounding said first annular wall member so as to define with said first annular wall member an annular oil chamber such that heat from said annular heating chamber heats oil disposed within said annular oil chamber which, in turn, heats said first annular wall member of said melter container whereby enhanced uniform heating efficiency of said melter container is achieved.

10. The integral melter and pump system as set forth in claim 9, further comprising:

a floor member integrally connected to said fourth annular wall member and disposed beneath said floor member of said melter container such that said annular oil chamber also extends beneath said floor member of said melter container.

11. A method of making an integral melter and pump system, comprising the steps of:

providing a melter container for containing melted material to be dispensed, wherein said melter container comprises a floor member and a first annular wall member integrally connected to said floor member and has an inner peripheral surface facing an interior portion of said melter container and an outer peripheral surface external of said melter container;

proving a burner for providing heat to said melter container for melting material charged into said melter container such that the material charged into said melter container is melted by the heat from said burner;

disposing a burner chamber beneath said floor member of said melter container such that said burner chamber is disposed in fluidic communication with said burner whereby heat from said burner is transmitted into said burner chamber such that the heat present within said burner chamber heats said floor member of said melter container;

disposing a second annular wall member radially spaced from said first annular wall member, surrounding said first annular wall member so as to define with said first annular wall member an annular heating chamber, and fluidically connecting said annular heating chamber to said burner chamber so as to receive heat from said burner chamber and thereby heat said first annular wall member so as to in turn heat said first annular wall member of said melter container; and mounting an output dispensing supply pump directly upon said outer peripheral surface of said first annular wall member of said melter container in a surface-to-surface manner such that heat from said interior portion of said melter container is transmitted, by conduction, through said first annular wall member of said melter container and to said output dispensing supply pump in order to constantly maintain said output dispensing supply pump in a heated state.

12. The method of making an integral melter and pump system as set claim 11, further comprising the steps of:

integrally affixing a planar pump mounting plate within said first annular wall member of said melter container; and mounting said output dispensing supply pump directly upon said planar pump mounting plate in a surface-to-surface manner such that heat from said interior portion of said melter container is transmitted, by conduction, through said planar pump mounting plate and to said output dispensing supply pump in order to constantly maintain said output dispensing supply pump in a heated state.

13. The method of making the integral melter and pump system as set claim 11, further comprising the steps of:

integrally affixing a planar pump mounting plate upon said annular wall member of said melter container; and mounting said output dispensing supply pump directly upon said planar pump mounting plate in a surface-to-surface manner such that heat from said interior portion of said melter container is transmitted, by conduction, through said planar pump mounting plate and to said output dispensing supply pump in order to constantly maintain said output dispensing supply pump in a heated state.

14. The method of making the integral melter and pump system as set forth in claim 11, further comprising the step of:

mounting said burner upon an external wall portion of said burner chamber so as to be readily accessible to maintenance personnel for the performance of maintenance operations.

15. The method of making the integral melter and pump system as set forth in claim 11, further comprising the step of:

removably mounting said burner within said burner chamber so as to be readily accessible to maintenance personnel for the performance of maintenance operations.

16. The method of making the integral melter and pump system as set forth in claim 11, further comprising the step of:

disposing a third annular wall member radially spaced from said second annular wall member and surrounding said second annular wall member so as to define with said second annular wall member an annular insulation chamber.

17. The method of making the integral melter and pump system as set claim 16, further comprising the step of:

disposing a fourth annular wall member radially outwardly from said first annular wall member, spaced radially inwardly of said second annular wall member, and surrounding said first annular wall member so as to define with said first annular wall member an annular oil chamber such that heat from said annular heating chamber heats oil disposed within said annular oil chamber which, in turn, heats said first annular wall member of said melter container whereby enhanced uniform heating efficiency of said melter container is achieved.

* * * * *